US006219855B1

(12) United States Patent
Hsu

(10) Patent No.: US 6,219,855 B1
(45) Date of Patent: Apr. 24, 2001

(54) TOILET BOWL IN COMBINATION WITH PRESSURIZED FLUSH TANK

(75) Inventor: Walter W. Hsu, Yinlin Hsien (TW)

(73) Assignee: Walter's Co., Ltd., Yinlin Hsien (TW)

( * ) Notice: Subject to any disclaimer, the term of this patent is extended or adjusted under 35 U.S.C. 154(b) by 0 days.

(21) Appl. No.: 09/541,492

(22) Filed: Apr. 3, 2000

(51) Int. Cl.[7] ..... E03D 3/10
(52) U.S. Cl. ..... 4/354
(58) Field of Search ..... 4/354, 356, 357, 4/358, 359, 355, 353; 222/336, 340

(56) References Cited

U.S. PATENT DOCUMENTS 1,505,297 * 8/1924 Stephenson ..... 222/336
2,868,493 * 1/1959 Gray ..... 251/49
2,957,181 * 10/1960 Lamping ..... 4/354
4,991,742 * 2/1991 Chang ..... 222/95
5,005,226 * 4/1991 Basile et al. ..... 4/354
6,170,715 * 1/2001 Evans ..... 222/340

* cited by examiner

*Primary Examiner*—Lee Young
*Assistant Examiner*—Huyen Le
(74) *Attorney, Agent, or Firm*—Bacon & Thomas, PLLC

(57) ABSTRACT

A toilet bowl in combination with a pressurized flush tank is presented wherein the pressurized tank has a spring, a float piston, a water inlet control valve set, a water discharge control unit and a container lid. The water inlet control valve set includes a valve unit, a valve cover, a small spring, a control piston, a seal ring, a float and a control wire. The water discharge control unit has a control handle, a link bar, a seal ring, two link bar fixing seats, a seal cap and a set of discharge fixing ring. When water is discharged, the compressed spring applies a force to the float piston so that the float piston will exert pressure on water which rushes into a toilet bowl as a result.

4 Claims, 5 Drawing Sheets

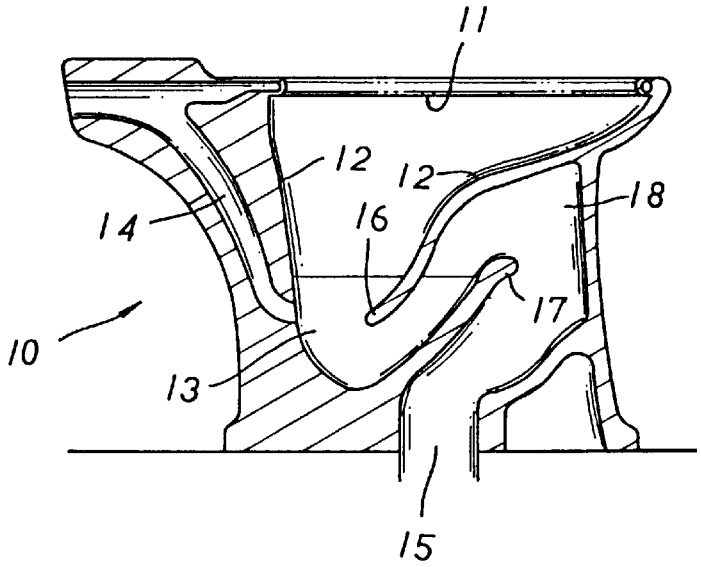
FIG. 1 PRIOR ART
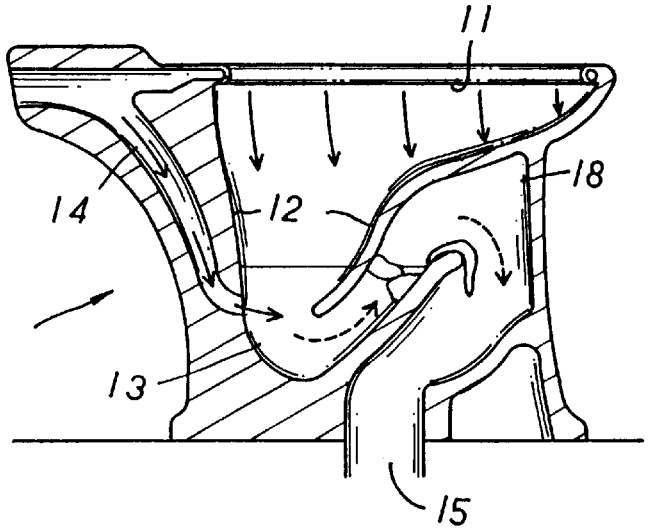
FIG. 2 PRIOR ART

TOILET BOWL IN COMBINATION WITH PRESSURIZED FLUSH TANK

BACKGROUND OF THE INVENTION

The present invention relates to an improved toilet bowl in combination with a pressurized flush tank. The pressurized tank is made up of a spring, a float piston, a water inlet control valve set, a water discharge control unit and a container lid. The water inlet control valve set includes a valve, a valve cover, a small spring, a control piston, a seal ring, a float base and a control cord. The water discharge control unit has a control handle, a link bar, a seal ring, two link bar fixing seats, a water stopper and a set of discharge fixing ring. When water is discharged, the compressed spring applies a force to the float piston so that the float piston will exert pressure on water which rushes into a toilet bowl as a result.

Referring to FIG. 1, a conventional toilet bowl 10 sectionally shown is provided with a plurality of flushing holes 11 defined on the top periphery of the bowl with slant flushing slopes 12 disposed inside thereof A water collection area 13 is disposed at the bottom of the toilet bowl 10. A downwardly extending water discharge tunnel 14 is disposed at a rear section of the flushing slope 12 and communicates with the same water source of the flushing holes 11 at the top end thereof and is in communication with the water collection area 13 at the bottom end thereof. The front section of the water collection area 13 extends in connection to a goose neck shaped dumping pipe 15 which has a front stop section 16 at the front end thereof and a rear stop section 17 at the rear end thereof. When the water collection area 13 is full of water, foul odor in the dumping pipe 15 can be stopped from entering and a vacuum chamber 18 is defined at the upper space of the dumping pipe 15.

Referring to FIG. 2, it shows the direction of water flow. When water flushes into the toilet bowl, it will be first discharged from the top of the bowl out of the flushing holes 11 and flushes down along the flushing slopes 12, producing a turbulent whirlpool. At the same time, water flushes down from the water discharge tunnel 14 to permit the whirling water to be discharged out of the dumping pipe 15. It will produce a siphon state in the vacuum chamber 18 so that waste in the toilet bowl can be sucked out of the same as a result of the siphon state.

There are some disadvantages associated with the prior toilet bowl given as below:

1. The water discharge tunnel 14 has a steep angle, almost a right angle, at the top end thereof, so, water flushing out of an outlet will become weak as a result of vast change of angle of the water flow. Thus, it takes more water to effectively flush waste in a toilet bowl out
2. The water collection area 13 remains less quantity of water in a very short period of time and then a reverse flow will be produced in the water collection area 13 by the water discharge tunnel 14. As a result, waste or fowl odor in the dumping pipe 15 will be sucked back. It is not hygienic to most people.

SUMMARY OF THE INVENTION

The primary object of the present invention is to provide a toilet bowl in combination with a pressurized flush tank which is operated without any electrical power to get water pressurized to flush waste and water out of a toilet bowl whereby the flush tank can be reduced in size and water discharged from the tank is economically saved.

Another object of the present invention is to provide an improved toilet bowl in combination with a pressurized flush tank. The toilet bowl of the present invention is provided with a back flushing tunnel which can build up a siphon state on filth waste and water being discharged in a vacuum chamber with a siphon state produced simultaneously so that filth water and waste can be dumped out effectively with less water used.

One further object of the present invention is to provide an improved toilet bowl in combination with a pressurized flush tank. The toilet bowl has a smoother dumping path which has no sharp angles of its structure so that filthy water and waste can be more directly dumped with no whirlpool produced in the water collection area in use. It is more hygienic than a conventional one.

BRIEF DESCRIPTION OF THE DRAWINGS

FIG. 1 is a sectional diagram showing the operation mode of the present invention;

FIG. 2 is another sectional diagram showing the operation mode thereof;

DETAILED DESCRIPTION OF THE PREFERRED EMBODIMENT

Figure 3:
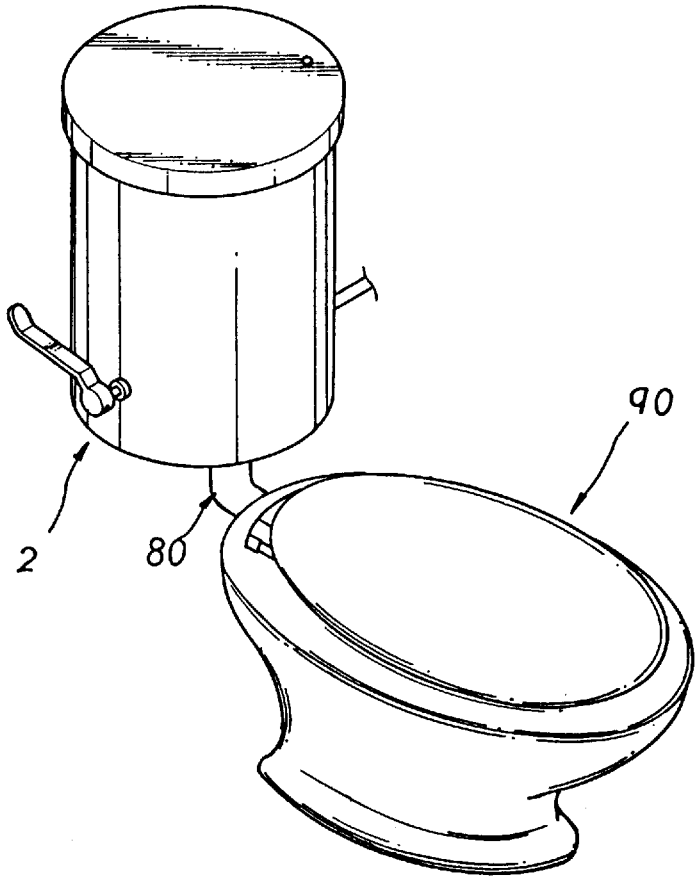
FIG. 3 is a perspective diagram showing the present invention.
Figure 5:
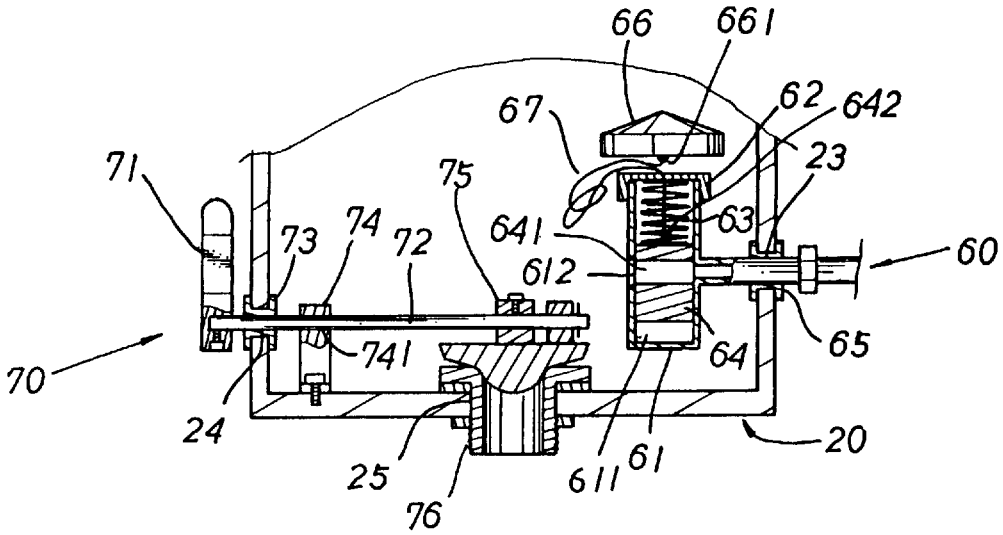
FIG. 5 is a sectional diagram showing the pressurized flush tank of the present invention.
Figure 4:
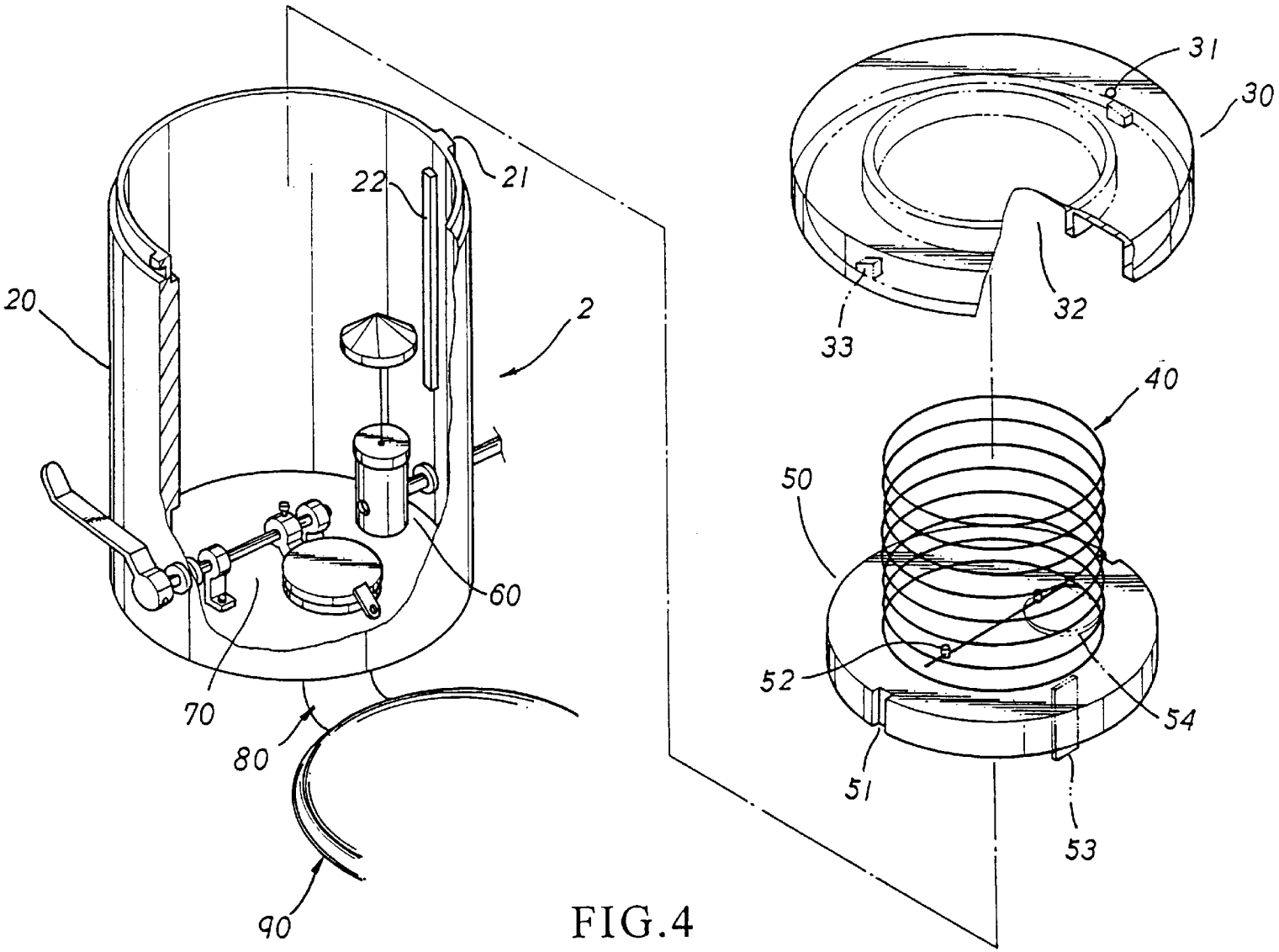
FIG. 4 is a perspective diagram showing exploded components of a pressurized flush tank.

Referring to FIG. 3, the toilet bowl in combination with a pressurized flush tank of the present invention includes a tank 2 which is connected to a toilet bowl 90 by a pipe 80. The tank 2 comprises a tank embodiment 20, a top lid 30, a spring 40, a float piston 50, a water inlet control valve set 60 and a water outlet control valve set 70, as shown in details in FIGS. 4, 5.

The tank embodiment 20 of a long cylindrical form has a top peripheral flange having a reduced diameter. A pair of symmetric trapezoidal retaining blocks 21 project from the top peripheral flange. A pair of symmetric vertical slide tracks 22 are axially disposed on the inner wall on the upper portion of the cylindrical tank embodiment 20. On the wall of the lower portion of the tank embodiment 20 and at two symmetric positions are disposed a pipe hole 23 and a shaft hole 24 and at the bottom plane is disposed a water outlet pipe hole 25.

The top lid 30 has a vent 31 disposed adjacent the peripherally projected edge of a housing recess 32 for locating one end of a spring 40 and has a pair of trapezoidal locking blocks 33 symmetrically disposed on an inner peripheral edge thereof.

The float piston 50 has a pair of symmetrically disposed vertical grooves 51 on the periphery thereof, which are defined in correspondence to the vertical slide tracks 22 of the tank embodiment for slidable engagement in installation. On the top face of the float piston 50 are disposed two securing projections 52 for retaining the spring 40 in place and adjacent the bottom periphery of the float piston 50 is disposed a downwardly extended positioning plate 53. On the bottom face of the float piston 50 is disposed a float receiving cavity 54.

The water inlet control valve set 60 is made up of a valve unit 61, a valve cap 62, a spring 63, a control piston 64, a sealing ring 65, a float 66 and a control wire 67. The sealing ring 65 is engaged with the pipe hole 23 of the tank embodiment 20 so as to permit the valve unit 61 to stick out of the tank embodiment and connect to a water inlet pipe. The valve unit 61 has an internal receiving space 611 and a water outlet 612 on the wall thereof. A control piston 64 housed in the receiving space 611 of the valve unit 61 is provided with a discharge tunnel 641. In the receiving space 611 and on the top surface of the control piston 64 is disposed a securing ring element 642. The valve cap 62 is fixedly mounted to the top of the valve unit 61 with a wire bore 621 defined at the center thereof. At the bottom of the float 66 is disposed a retaining ring 661. One end of the control wire 67 led through the wire bore 621 is secured to securing ring element 642 of the control piston 64 and the other end of the control wire 67 is fixed to the retaining ring 661 of the float 66.

The water outlet control valve set 70 comprises a control handle 71, a link bar 72, a sealing ring 73, a pair of link bar mounts 74, a seal cap 75 and a discharge pipe head 76 fixed to the water outlet pipe hole 25 of the tank embodiment 20. A pipe 80 is connected to the outlet pipe hole 25. The two link bar mounts 74 fixed to the bottom of the tank embodiment 20 are respectively provided with a shaft hole 741. A sealing element 73 is disposed at the shaft hole 24. The link bar 72 is pivotal engaged with the two shaft holes 741 of the link bar mounts 74 and the sealing element 73. The control handle 71 is secured to an externally exposed end of the link bar 72 by a screw. The seal cap 75 is removably fixed to the link bar 72 and is just in sealing engagement with the discharge pipe head 76.

Thereby, the spring 40 is fixed to the two securing projections 52 of the top surface of the float piston 50. Then the float piston 52 is slidably engaged with the vertical slide tracks 22 inside of the tank embodiment 20 by way of the vertical grooves 51 thereof. The top lid 30 is secured to the top of the tank embodiment 20 by rotation of the top lid 30 so that the retaining blocks 21 can be in locking engagement with the locking blocks 33. At the same time, the spring 40 is just fitted in the housing recess 32 of the top lid 30.

Figure 6:
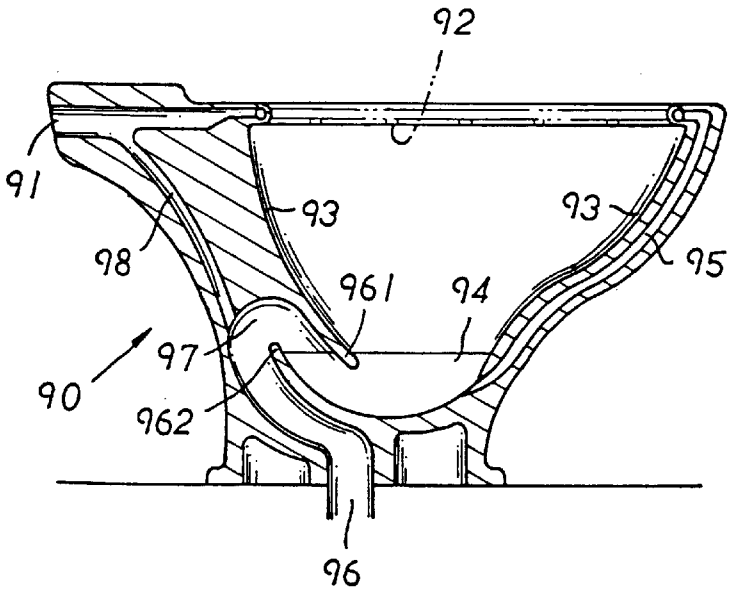
FIG. 6 is a sectional diagram of an improved toilet bowl of the present invention.

Referring to FIG. 6, the toilet bowl 90 of the present invention is sectionally shown. A water inlet path 91 is disposed at the top corner and periphery at the rear end of the toilet bowl 90 and on the periphery of the toile bowl 90 are defined a plurality of flush holes 92 communicating with water inlet path 91. On the interior of the toilet bowl 90 are defined downwardly extended flushing slopes 93 and at the bottom of the toilet bowl 90 is disposed a water collection area 94. A front water flushing passage 95 is defined behind one of the flushing slopes 93. The front water flushing passage 95 is in communication with the water inlet path 91 at the top end and communicates with the water collection area 94 at the bottom end thereof. At a rear end of the water collection area 94 is disposed a goose-like waste discharge path 96 which is connected to a sewage tunnel. At the front end of the waste discharge path 96 is disposed a front stop edge 961 in smooth connection to one of the flushing slope 93 and at the rear end of the water collection area 94 is placed a rear stop edge 962.

When water collection area 94 is filled up with water having a level reaching the edges of the front stop edge 961 and the rear stop edge 962, foul odor produced in the waste discharge path 96 can be stopped from distributing into a room via the waste discharge path 96. A vacuum chamber 97 is formed in the sharply curved area of the waste discharge path 96. Communicating with the vacuum chamber 97 is a rear water flushing passage 98 which communicates with the water inlet path 91. The front water flushing passage 95 having its outlet end in alignment with the opening of the goose like waste discharge path 96.

Figure 8:
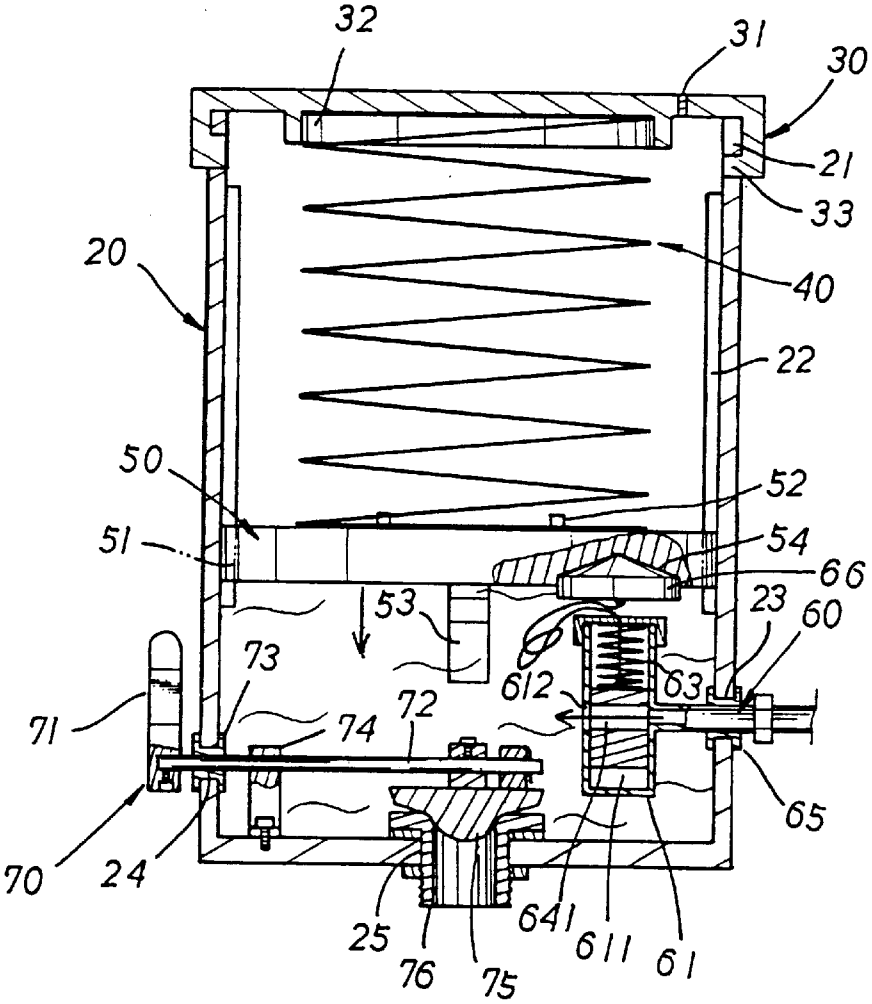
FIG. 8 is a sectional diagram showing the pressurized tank running out of water.
Figure 7:
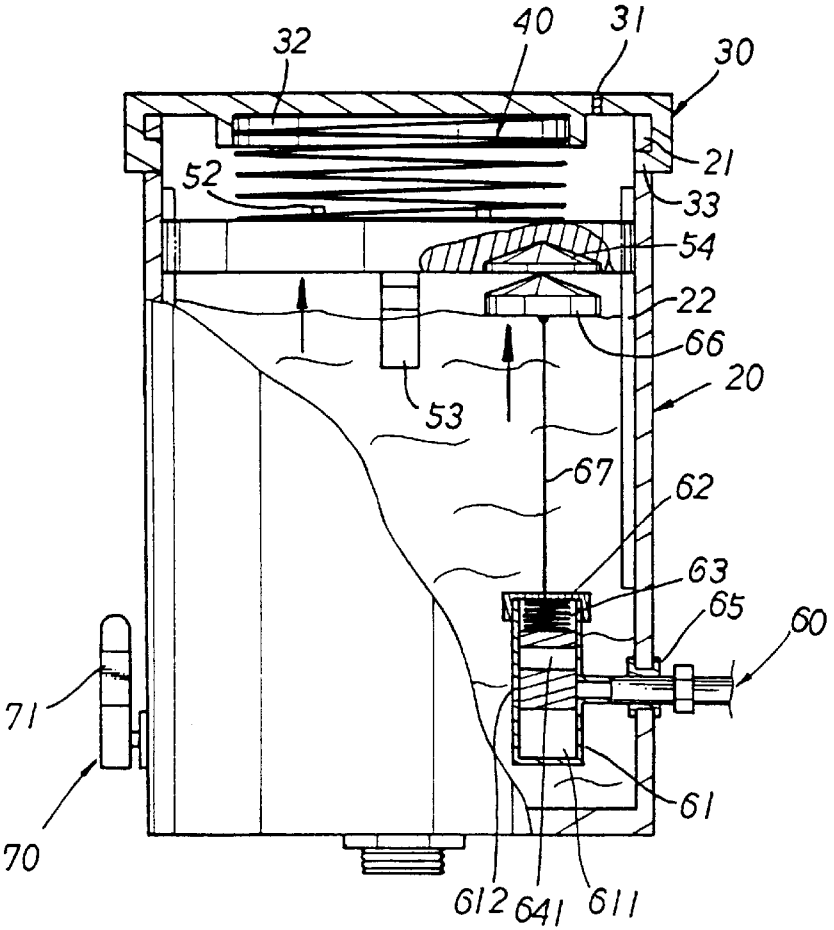
FIG. 7 is a sectional diagram showing the pressurized tank full of water.
Figure 9:
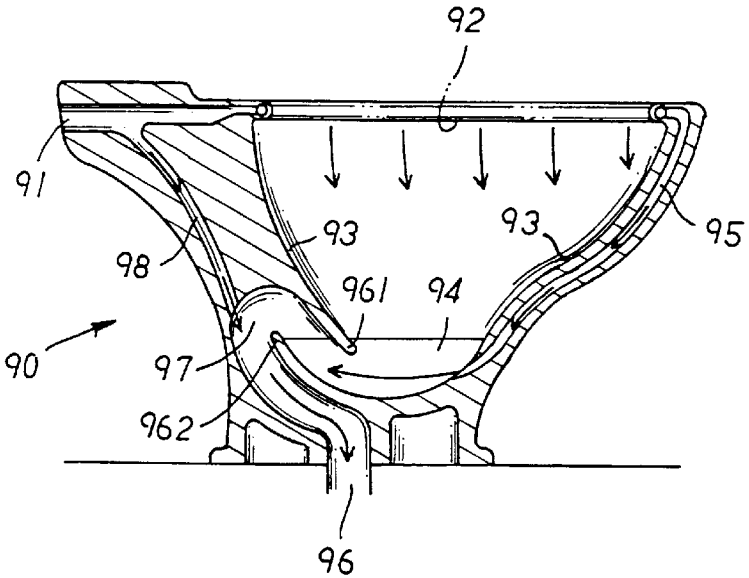
FIG. 9 is a diagram showing water being flushed in the toilet bowl.

Referring to FIGS. 7,8,9, when the tank 20 is to be filled with water, i.e., it is empty then, the float piston 50 is being forced by the spring 40 to a proper position near the bottom of the tank 20. At this time the float 66 is engaged with the float receiving cavity 54 on the underside of the float piston 50, and the control wire 67 is in a loose state; as a result, the spring 63 in the valve unit 61 is downwardly extended and forces the control piston 64 to such a position that the discharge tunnel 641 of the control piston 64, the water outlet 612 of the valve unit 61 and the water pipe in communication with the valve unit are in linear alignment. Thereby water can be delivered into the tank 20 accordingly.

As the control handle 71 is pressed down to get the toilet bowl flushed, the seal cap 75 is activated by the link bar 72 so as to get the discharge pipe head 76 opened for permitting water to be delivered out of the water inlet path 91 of the toilet bowl 90 via the pipe 80. Then, the spring 40 has a larger force than the internal force of the valve unit 61, so, the spring 40 will exert a downward force on the float piston 50 which will pressurize water to flow into the water inlet path 91 of the toilet bowl 90 and to flush out of the flush holes 92. As a result, water will flush down along the flushing slopes 93 to produce a turbulent whirlpool and at the same time, the pressurized water will smoothly rush down the water flushing passage 95 and flow into the waste discharge path 96. Simultaneously, a siphon state will be produced in the vacuum chamber 97 in the waste discharge path 96 accordingly and a water flow flushes down the rear water flushing passage 98, resulting in building up of the siphon state in the vacuum chamber 97 of the waste discharge path 96 to effectively suck waste and filthy water out of the waste discharge path 96. At then, the float 66 will move down to cause the control piston 64 to position in such a place that water can flow into the tank 20 via the valve unit 61. The lifted seal cap 75 will be touched and forced to close by the positioning plate 53 extended downwardly from the float piston 50.

As water continues pouring in with the level of water in the tank 20 going up, the float piston 50 lifts up, making the spring 40 compressed. During the period, the float 66 will be lifted up along with the raise of water level in the tank 20. As long as the control wire 67 is not completely extended to its preset length, water will keep on flushing in the tank 20 until the float 66 moves to such a position that the control wire 67 is fully straightened up. As a result of the buoyancy of the float 66 larger than the force of the spring 63 disposed between the control piston 64 and the valve cap 62, the control piston 64 is lifted up to a summit position to cut off the inlet of water via the discharge tunnel 641 into the tank 20. Since the valve unit 61 and the control piston 64 are made of ceramic material that can be sealedly matched, no seal rings are needed, making the moving elements smoothly operated with ease.

In summary, the present invention has the following advantages in use:

1. Waste in toilet bowl can be flushed with economic amount of water.
2. It is effectively operated because of production of siphon states in a toilet bowl which can suck waste therein efficiently out of the toilet bowl.

3. The smoother flushing slopes in the toilet bowl make discharge of waste and filthy water out of toilet bowl fast without producing turbulent whirlpool therein.

I claim:

1. A toilet bowl in combination with a pressurized flush tank, said toilet bowl being connected to said pressurized flush tank by way of a water pipe; wherein:

said pressurized flush tank has a float piston limitedly movable up and down in response to variation of water level in said flush tank;

a spring disposed on top of said float piston is compressible and extendible in response to upward and downward movement of said float piston as a result of variation of water level in said flush tank whereby pressure can be produced on water in the flush tank when said water is discharged out of said flush tank by said float piston pressurized by said compressed spring;

a positioning plate disposed at a bottom side of said float piston;

a control valve set is engaged with said flush tank for controlling input of water into said flush tank;

said control valve set including a valve unit;

said valve unit has a tubular case in which a control piston is movable up and down and a water outlet is defined on a wall of said valve unit;

said valve unit communicates with a water source and said control piston has a water discharge tunnel;

a spring is disposed on top of said control piston so as to make said control piston retractably movable up and down;

said control piston is connected to a float which is movably housed in said tank by way of a flexible wire so as to make said control piston move in accordance with water level in said flush tank;

water flows into said flush tank when said control piston moves to such a position that said water discharge tunnel of said control piston comes into alignment with both said water source and said water outlet of said valve unit;

a seal cap disposed at a bottom of said flush tank is in closing and opening engagement with a discharge pipe head;

a control handle pivotal fixed to said flush tank is connected to said seal cap so as to permit said seal cap to open when said control handle is activated;

said seal cap can be closed by said positioning plate fixed to said float piston when water level in said flush tank is dropped to such an extent that said float piston moves down along with dropped water level to allow said positioning plate to touch said seal cap pivoted to open by said control handle;

whereby said toilet bowl has a downwardly extended flushing slope from a periphery thereof and has a water collection area defined at a bottom end of said flushing slope; a plurality of flush holes are disposed on said periphery of said toilet bowl; said flush holes communicate with a water inlet path which is connected to said flush tank; a goose neck shaped waste discharge path in connection to said water collection area; a vacuum chamber is defined at a sharp turn of said goose neck shaped waste discharge path adjacent to said water collection area;

a first water flushing passage communicating with said water inlet path at one end communicates with said vacuum chamber of said waste discharge path at another end; a second water flushing passage disposed under said flushing slope communicates with said water collection area;

whereby a siphon state can be produced in said vacuum chamber of said goose neck shaped waste discharge path when water is flushed out of said first and second water flushing passage and said flush holes of said toilet bowl to effectively speed up the discharge of waste and filth water accumulated in said water collection area of said toilet bowl.

2. The toilet bowl in combination with a pressurized flush tank as claimed in claim 1 wherein:

said float piston has a float receiving cavity so as to permit said float to be fit therein when said float and said float piston come into contact with each other.

3. The toilet bowl in combination with a pressurized flush tank as claimed in claim 1 wherein said flush tank is of a cylindrical shape.

4. The toilet bowl in combination with a pressurized flush tank as claimed in claim 1 wherein said flush tank has a pair of symmetric vertical slide tracks partially disposed on an inner wall thereof so as to permit said float piston to limitedly move up and down in response to the variation of water level.

* * * * *